United States Patent [19]

Scarano

[11] Patent Number: 4,651,495

[45] **Date of Patent: * Mar. 24, 1987**

[54] BLOCK LEVELING AND FOUNDATION MAKING METHODS

[75] Inventor: Gary Scarano, East Brunswick, N.J.

[73] Assignee: Auto Leads, Inc., Matawan, N.J.

[ * ] Notice: The portion of the term of this patent subsequent to Sep. 11, 2001 has been disclaimed.

[21] Appl. No.: 663,311

[22] Filed: Oct. 22, 1984

[51] Int. Cl.[4] ..... E04G 21/18

[52] U.S. Cl. ..... 52/747; 33/404; 33/410

[58] Field of Search ..... 52/747, 741; 33/404–410

[56] References Cited

U.S. PATENT DOCUMENTS

| | | | |
|---|---|---|---|
| 402,360 | 4/1889 | Smith | 33/410 |
| 441,492 | 11/1890 | Kelley | 33/410 |
| 614,577 | 11/1898 | Reineking | 33/410 |
| 995,714 | 6/1911 | Platt | 33/410 |
| 1,092,058 | 3/1914 | Knott et al. | 33/410 |
| 2,659,973 | 11/1953 | Patzel | 33/410 |
| 2,665,487 | 1/1954 | Mastrella | 33/408 |
| 2,685,741 | 8/1954 | Wilkinson | 33/410 |
| 2,728,142 | 12/1955 | Betterton | 33/85 |
| 2,761,214 | 9/1956 | Ruble | 33/410 |
| 2,788,579 | 4/1957 | Mills | 33/410 |
| 2,833,043 | 5/1958 | Patejdl | 33/408 |
| 2,919,489 | 1/1960 | Espinosa | 33/410 |
| 3,148,453 | 9/1964 | DiCarlo | 33/85 |
| 3,299,515 | 1/1967 | Lessard | 33/408 |
| 3,318,004 | 5/1967 | Payne | 33/404 |
| 3,397,458 | 8/1968 | Wicklund | 33/410 |
| 3,751,810 | 8/1973 | Valva | 33/410 |
| 3,955,332 | 5/1976 | Genis | 52/747 |
| 4,359,850 | 11/1982 | Sinkes | 52/747 |
| 4,470,200 | 9/1984 | Scarano | 33/408 |

FOREIGN PATENT DOCUMENTS

| | | | |
|---|---|---|---|
| 104711 | 8/1938 | Australia | 33/404 |
| 829788 | 1/1952 | Fed. Rep. of Germany | 33/404 |

*Primary Examiner*—J. Karl Bell

*Attorney, Agent, or Firm*—Ralph W. Selitto, Jr.

[57] ABSTRACT

Methods for leveling masonry blocks and making a foundation from such blocks are disclosed by which two substantially complete courses of blocks can be laid and leveled without having to construct lead corners.

7 Claims, 20 Drawing Figures

(e)

BLOCK LEVELING AND FOUNDATION MAKING METHODS

FIELD OF THE INVENTION

The present invention relates to block leveling methods, and, more particularly, to such methods which are especially adapted to facilitate the construction of walls and foundations made from masonry blocks. As used herein, the term "masonry blocks" denotes cement blocks, cinder blocks, bricks and all other equivalent types of construction materials.

BACKGROUND OF THE INVENTION

When constructing a building wall made from masonry blocks, masons normally erect guide blockwork at the corners of the wall. The guide blockwork at each corner is typically referred to as a lead corner. From these lead corners, a guide line is stretched to facilitate the laying and leveling of the remaining blocks.

One primitive method of trigging the guide line is to drive a nail or spike into the mortar between the blocks of opposite lead corners and then tightly stretch the guide line between the nails or spikes. If the guide line is stretched too tightly, the mortar can crack and cause the guide line to sag, thereby inhibiting the laying of a straight and level wall.

In an effort to improve upon the primitive trigging method described above, numerous more sophisticated techniques have been developed to trig the guide line. These prior techniques are not completely satisfactory because they utilize devices which require either (i) construction of lead corners or a substantial portion of a course (see, for instance, U.S. Pat. Nos. 402,360; 441,492; 614,577; 1,092,058; 2,685,741; 2,728,142; 2,761,214; 2,788,579; 2,833,043 and 3,397,458) or (ii) repositioning in order to lay multiple courses (see, for instance, U.S. Pat. Nos. 995,714; 2,659,973; 2,665,487 and 3,148,453). The construction of lead corners or a substantial portion of a course is time consuming and therefore undesirable. It is also time consuming and therefore undesirable to resposition the trigging devices after each course has been laid.

SUMMARY OF THE PRESENT INVENTION

In accordance with one embodiment of the present invention, a new and improved method of laying multiple courses of blocks involves laying and leveling a block at one end of a first course and laying and leveling another block at an opposite end of the first course. After mounting a block leveling device, which includes first and second guiding mechanisms, on one of the end blocks and mounting a second block leveling device, which also includes first and second guiding mechanisms, on the other end block, a guide line is attached to the block leveling devices such that the first guiding mechanisms cooperate to guide the guide line in a generally horizontal direction along aligned upper edges of the end blocks. Interior blocks of the first course are then laid between the end blocks using the guide line to facilitate their leveling. The same or another guide line can then be attached to the second guiding mechanisms such that it is guided in a horizontal directon at a preselected elevation above the upper edges of the first course blocks to facilitate the leveling of at least some of the blocks which constitute a second course of blocks. Thus, at least two substantially complete courses of blocks can be laid and leveled without having to move the leveling devices and without having to construct lead corners.

Lead corners are time consuming to construct because they require the manual plumbing and leveling of several blocks. In order to reduce construction time, several masons are usually employed to construct the lead corners. By eliminating the necessity of constructing lead corners, the number of blocks which must be manually plumbed and leveled is reduced, thereby reducing construction time and the number of masons required to lay and level the two or more courses of blocks.

In accordance with another embodiment of the present invention, the above-described method can be utilized to form the first two courses of each wall of a foundation. Although the resulting first course of blocks would be complete, the second course would be missing a block in each corner of the foundation. In order to complete the second course, blocks are manually laid in each corner of the foundation using the interior second course blocks as guides. Additional courses can then be formed in basically the same manner as the second course. Thus, the entire foundation can be constructed without having to construct lead corners, thereby resulting in the advantages described above.

BRIEF DESCRIPTION OF THE DRAWINGS

For a better understanding of the present invention, reference is made to the following detailed description of two exemplary embodiments considered in conjunction with the accompanying drawings, in which.

Figures 1, 2, 3, 4, 5:
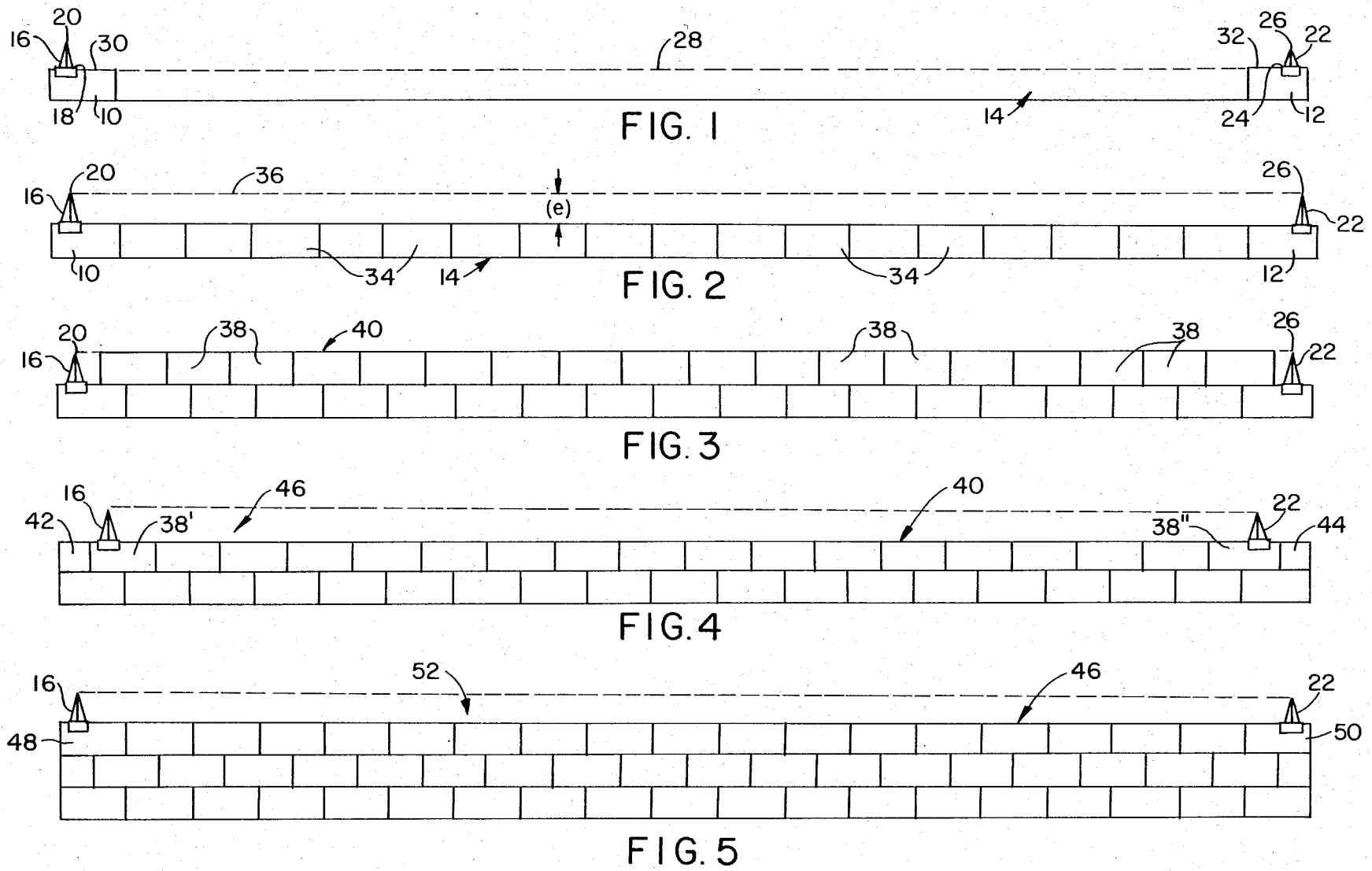
FIGS. 1–5 are schematic illustrations of various steps in a block laying method performed in accordance with one embodiment of the present invention.

DESCRIPTION OF THE BLOCK LAYING METHOD ILLUSTRATED IN FIGS. 1–5 AND THE FOUNDATION MAKING METHOD ILLUSTRATED IN FIGS. 6–20

Before describing the methods illustrated in FIGS. 1–20, it should be understood that the block leveling devices disclosed in U.S. Pat. No. 4,470,200 are especially useful in performing both methods, although other block leveling devices may be employed. In the following description of the methods illustrated in FIGS. 1–20, it will be assumed, unless otherwise indicated, that the block leveling devices employed in connection therewith are those illustrated in U.S. Pat. No. 4,470,200, the specification of which is incorporated herein by reference.

With reference to FIGS. 1–5, there is shown a method of laying multiple courses of blocks without constructing lead corners. More particularly, blocks 10, 12 are laid and leveled at opposite ends of a first course 14 (see FIG. 1). A first block leveling device 16, which includes a first guiding mechanism 18 and a second guiding mechanism 20, is mounted on the block 10, while a second block leveling device 22 which includes a first guiding mechanism 24 and a second guiding mechanism 26, is mounted on the block 12 (see FIG. 1). A guide line 28 is attached to the block leveling devices 16, 22 such that the first guiding mechanism 18, 24 cooperate to guide the guide line 28 in a generally horizontal direction along aligned upper edges 30, 32 of the blocks 10, 12, respectively (see FIG. 1). The remaining blocks 34 of the first course 14 are then laid between the blocks 10, 12 using the guide line 28 to facilitate their leveling (see FIG. 2). Without moving the block leveling devices 16, 22, a guide line 36, which can be the guide line 28 or another guide line, is attached to the second guiding mechanisms 20, 26 such that the guide line 36 is guided in a generally horizontal direction at a preselected elevation (e) above the upper edges 30, 32 of the blocks 10, 12, respectively (see FIG. 2). Blocks 38 of the second course 40 are then laid between the block leveling devices 16, 22 using the guide line 36 to facilitate their leveling (see FIG. 3). The preselected elevation (e) is approximately equal to the height of the blocks 38 plus the thickness of the mortar between the first course 14 and the second course 40. Before laying end blocks 42, 44 for the second course 40, the block leveling devices 16, 22 are mounted on preleveled interior blocks 38', 38'', respectively, of the second course 40 in preparation for laying a third course 46 (see FIG. 4). After the third course 46 has been completed, the block leveling devices 16, 22 can be mounted on end blocks 48, 50, respectively, of the third course 46 in preparation for laying a fourth course 52 (see FIG. 5).

Referring now to FIGS. 6–20, there is shown a method of making a foundation without constructing lead corners. To facilitate consideration and discussion, the following description of the foundation making method will make reference to compass directions, it being understood that such directions have been arbitrarily selected and thus are not intended to limit the method in any way.

Figure 6:
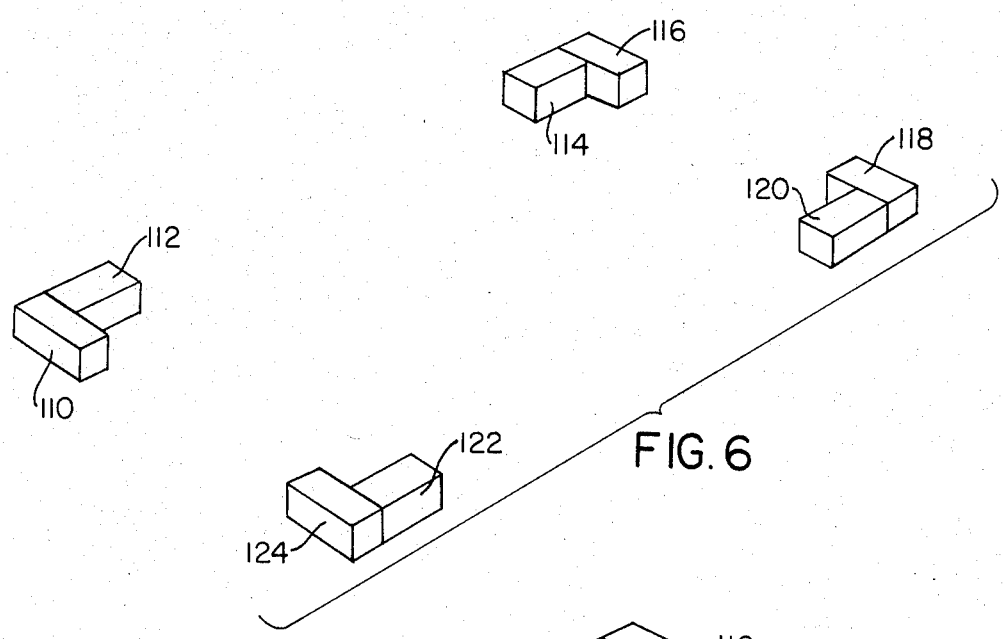
FIGS. 6–20 are schematic illustrations of various steps in a foundation making method performed in accordance with another embodiment of the present invention.

With reference to FIG. 6, blocks 110, 112 are laid manually, set to grade, leveled and plumbed to form a northwest corner of a rectangular foundation. In order to form a northeast corner of the foundation, blocks 114, 116 are laid manually, set to grade, leveled and plumbed. A southeast corner of the foundation is formed by blocks 118, 120 which are laid manually, set to grade, leveled and plumbed. Blocks 122, 124 are laid manually, set to grade, leveled and plumbed to form a southwest corner of the foundation.

Figure 7:
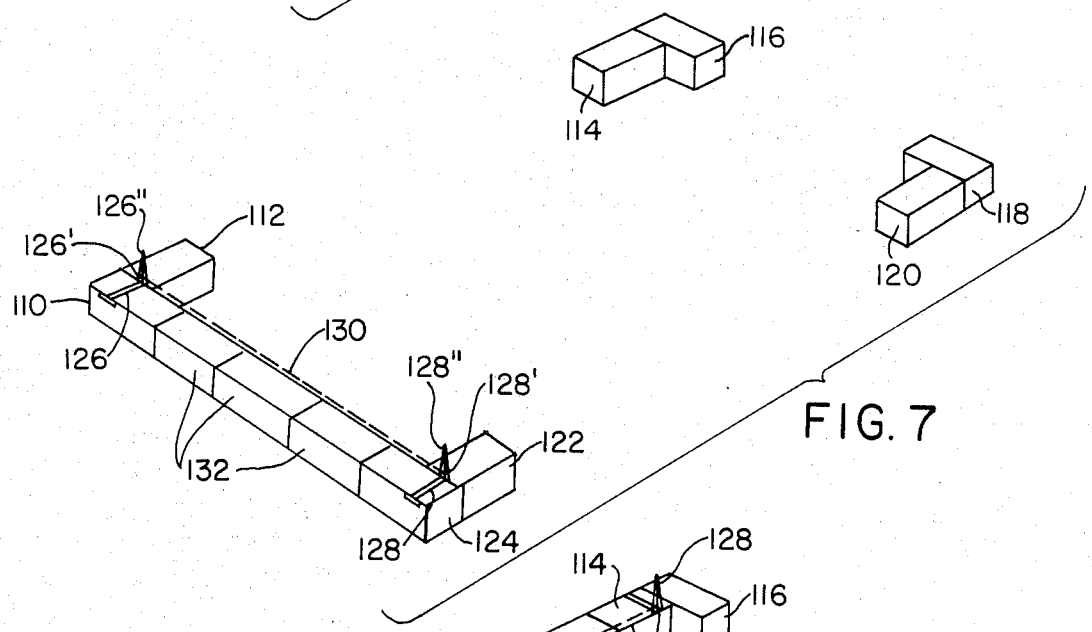

With reference to FIG. 7, a first block leveling device 126, which includes a lower guiding mechanism 126' and an upper guiding mechanism 126'', is mounted on the block 110, while a second block leveling device 128, which includes a lower guiding mechanism 128' and an upper guiding mechanism 128'', is mounted on the block 124. A guide line 130 is attached to the block leveling devices 126, 128 such that the lower guiding mechanisms 126', 128' cooperate to guide the guide line 130 in a generally horizontal direction along aligned upper edges 111, 125 of the blocks 110, 124, respectively. To complete the first course of a west wall of the foundation, blocks 132 are then laid between the blocks 110, 124 using the guide line 130 to facilitate their leveling. If the distance between the blocks 110, 124 is great, it may be desired to manually lay, set to grade, level and plumb one of the blocks 132 and then mount a suitable twigging device thereon to facilitate the guiding of the guide line 130 during the laying of the rest of the blocks 132.

Figure 8:
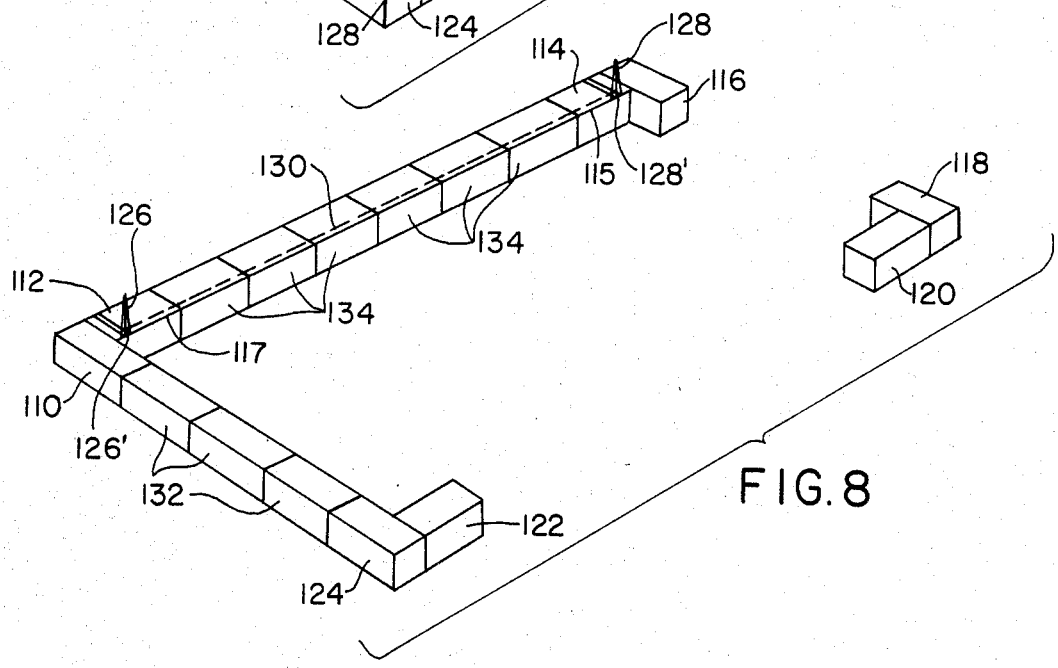

With reference to FIG. 8, the block leveling device 126 or another similar block leveling device is mounted on the block 112, while the block leveling device 128 or another similar block leveling device is mounted on the block 114. The guide line 130 is attached to the block leveling devices 126, 128 such that the lower guiding mechanisms 126', 128' cooperate to guide to the guide line 130 in a generally horizontal direction along aligned upper edges 113, 115 of the blocks 112, 114, respectively. To complete the first course of a north wall of the foundation, blocks 134 are then laid between the blocks 112, 114 using the guide line 130 to facilitate their leveling. If the distance between the blocks 112, 114 is great, it may be desired to manually lay, set to grade, level and plumb one of the blocks 134 and then mount a suitable twigging device thereon to facilitate the guiding of the guide line 130 during the laying of the rest of the blocks 134.

Figure 9:
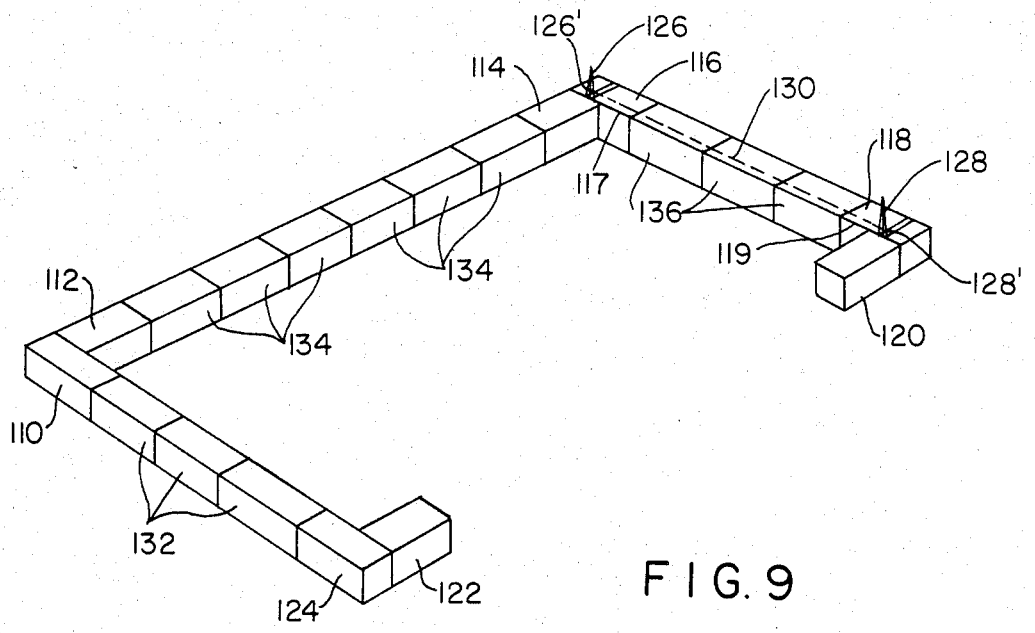

With reference to FIG. 9, the block leveling device 126 or another similar block leveling device is mounted on the block 116, while the block leveling device 128 or another similar block leveling device is mounted on the block 118. The guide line 130 is attached to the block leveling devices 126, 128 such that the lower guiding mechanisms 126', 128' cooperate to guide the guide line 130 in a generally horizontal direction along aligned upper edges 117, 119 of the blocks 116, 118, respectively. To complete the first course of an east wall of the foundation, blocks 136 are then laid between the blocks 116, 118 using the guide line 130 to facilitate their leveling. If the distance between the blocks 116, 118 is great, it may be desired to manually lay, set to grade, level and plumb one of the blocks 136 and then mount a suitable twigging device thereon to facilitate the guiding of the guide line 130 during the laying of the rest of the blocks 136.

Figure 10:
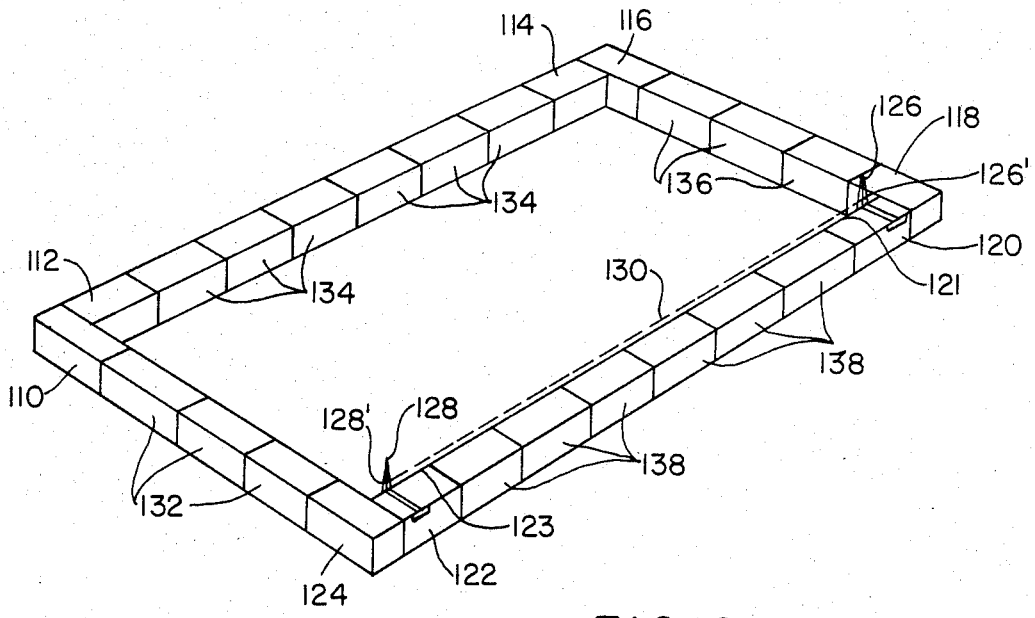

With reference to FIG. 10, the block leveling device 126 or another similar block leveling device is mounted on the block 120, while the block leveling device 128 or another similar block leveling device is mounted on the block 122. The guide line 130 is attached to the block leveling devices 126, 128 such that the lower guiding mechanisms 126', 128' cooperate to guide the guide line 130 in a generally horizontal direction along aligned upper edges 121, 123 of the blocks 120, 122, respectively. To complete the first course of a south wall of the foundation, blocks 138 are then laid between the blocks 120, 122 using the guide line 130 to facilitate their leveling. If the distance between the blocks 120, 122 is great, it may be desired to manually lay, set to grade, level and plumb one of the blocks 138 and then mount a suitable twigging device thereon to facilitate the guiding of the guide line 130 during the laying of the rest of the blocks 138.

By utilizing multiple sets of block leveling devices, the first course of two or more of the walls can be formed simultaneously. Thus, for instance, it is possible to form all four first courses simultaneously by employing four sets of block leveling devices.

Figure 11:
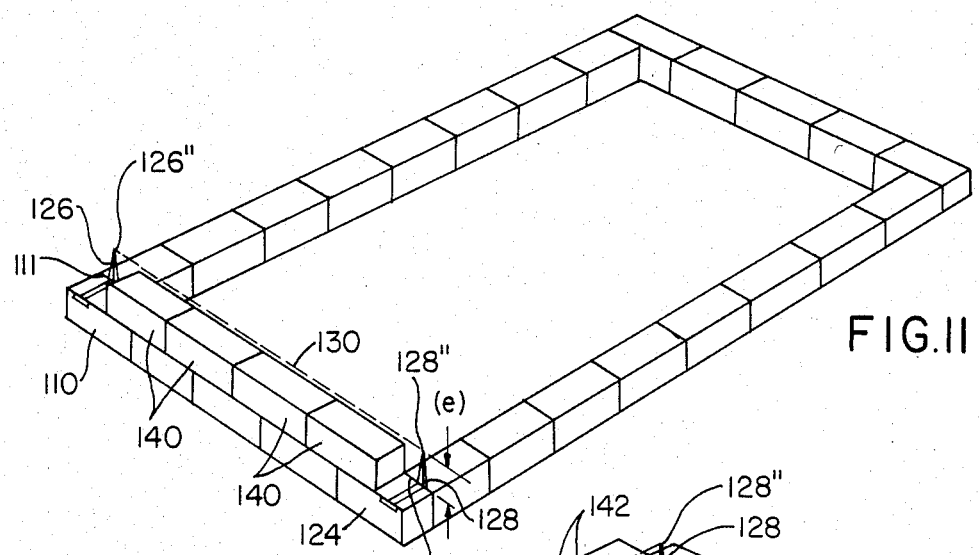

Referring to FIG. 11, with the block leveling device 126 mounted on the northern half of the block 110 and the block leveling device 128 mounted on the southern half of the block 124, the guide line 130 is strung between the upper guiding mechanisms 126'', 128'' such that the guide line 130 is guided in a generally horizontal direction at a preselected elevation (e) above the upper edges 111, 125 of the blocks 110, 124, respectively. Interior blocks 140 of the second course of the west wall are then laid between the block leveling devices 126, 128 using the guide line 130 to facilitate their leveling and plumbing. The preselected elevation (e) is approximately equal to the height of the blocks 140 plus the thickness of the mortar between the first and second courses.

Figure 12:
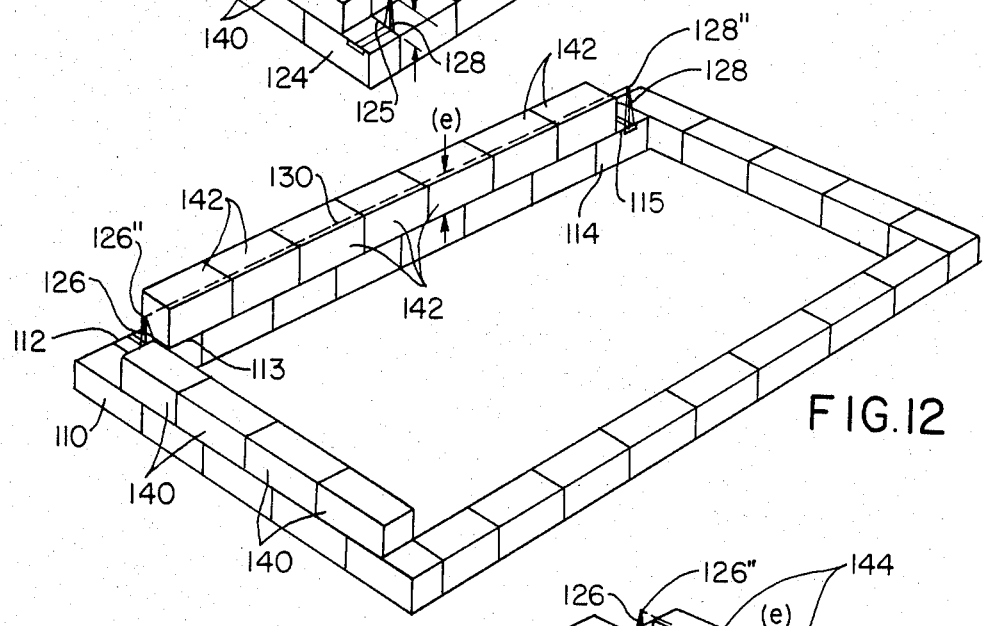

Referring to FIG. 12, with the block leveling device 126 mounted on the western half of the block 112 and the block leveling device 128 mounted on the eastern half of the block 114, the guide line 130 is strung between the upper guiding mechanisms 126", 128" such that the guide line 130 is guided in a generally horizontal direction at a preselected elevation (e) above the upper edges 113, 115 of the blocks 112, 114, respectively. Interior blocks 142 of the second course of the north wall are then laid between the block leveling devices 126, 128 using the guide line 130 to facilitate their leveling and plumbing. The preselected elevation (e) is approximately equal to the height of the blocks 142 plus the thickness of the mortar between the first and second courses.

Figure 13:
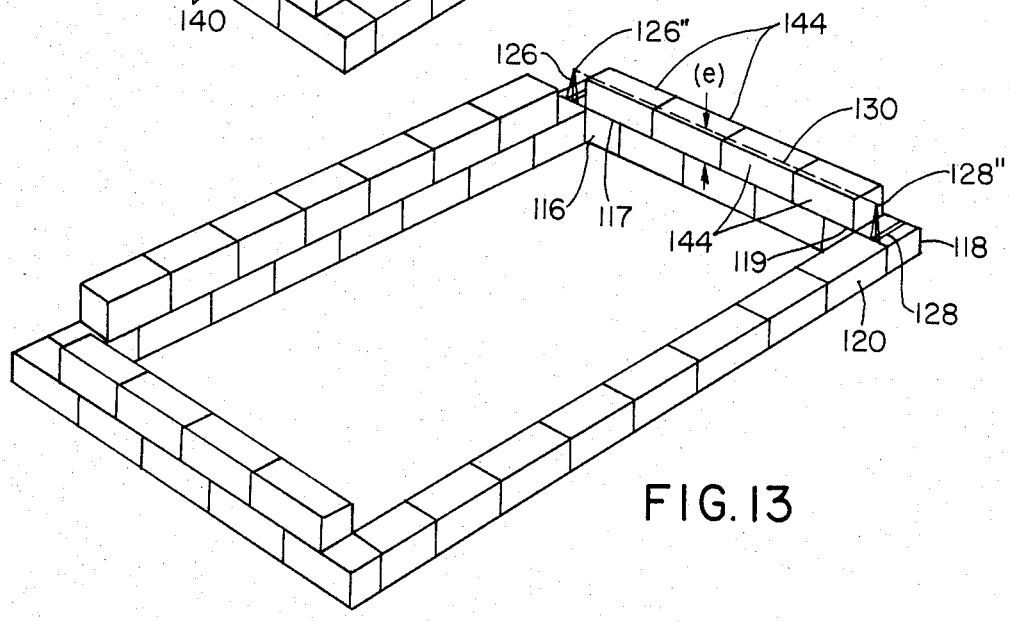

Referring to FIG. 13, with the block leveling device 126 mounted on the northern half of the block 116 and the block leveling device 128 mounted on the southern half of the block 118, the guide line 130 is strung between the upper guiding mechanisms 126", 128" such that the guide line 130 is guided in a generally horizontal direction at a preselected elevation (e) above the upper edges 117, 119 of the blocks 116, 118, respectively. Interior blocks 144 of the second course of the east wall are then laid between the block leveling devices 126, 128 using the guide line 130 to facilitate their leveling and plumbing. The preselected elevation (e) is approximately equal to the height of the blocks 144 plus the thickness of the mortar between the first and second courses.

Figure 14:
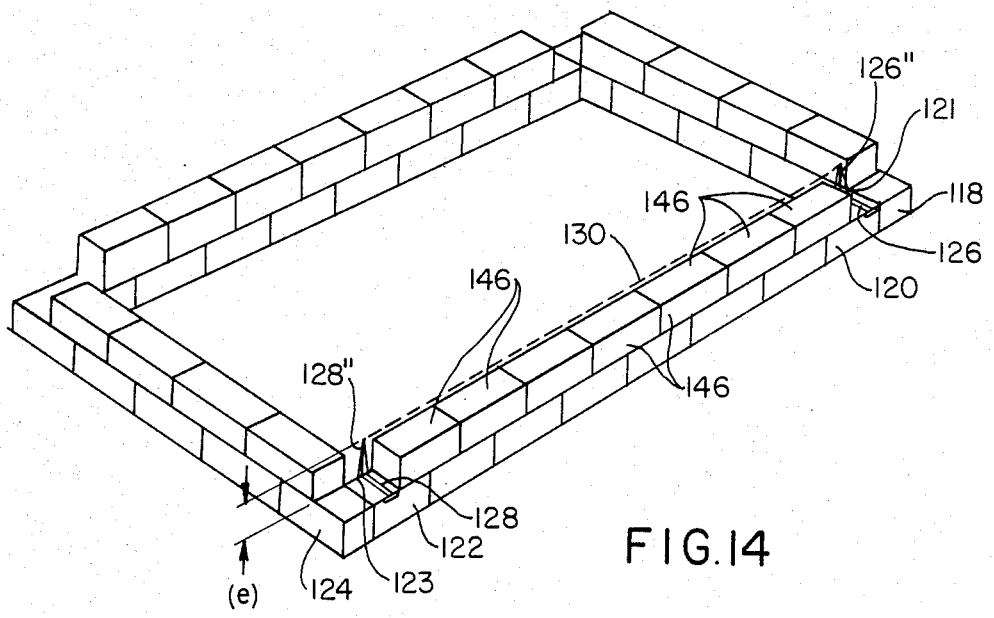

Referring to FIG. 14, with the block leveling device 126 mounted on the eastern half of the block 120 and the block leveling device 128 mounted on the western half of the block 122, the guide line 130 is strung between the upper guiding mechanisms 126", 128" such that the guide line 130 is guided in a generally horizontal direction at a preselected elevation (e) above the upper edges 121, 123 of the blocks 120, 122, respectively. Interior blocks 146 of a second course of the south wall are then laid between the block leveling devices 126, 128 using the guide line 130 to facilitate their leveling and plumbing. The preselected elevation (e) is approximately equal to the height of the blocks 146 plus the thickness of the mortar between the first and second courses.

Figure 15:
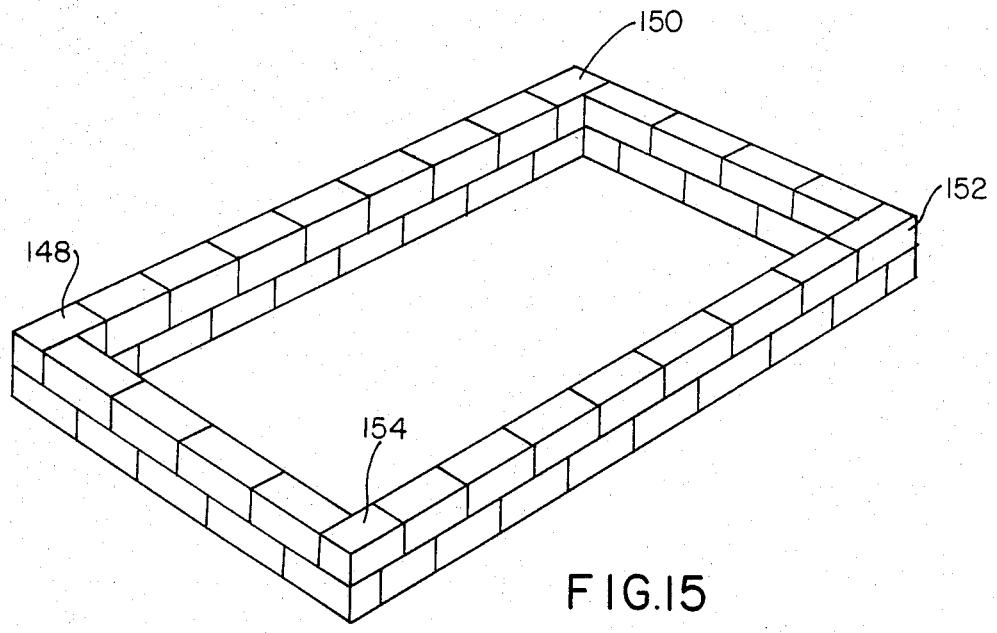

Referring to FIG. 15, with the block leveling devices 126, 128 removed, a block 148 is laid in the northwest corner of the foundation by ranging it in off of the blocks 140, 142 and then leveling it using the blocks 140, 142 as guides. In the northeast corner of the foundation, a block 150 is laid by ranging it in off of the blocks 142, 144 and then leveling it using the blocks 142, 144 as guides. A block 152 is laid in the southeast corner of the foundation by ranging it in off of the blocks 144, 146 and the leveling it using the blocks 144, 146 as guides. In the southwest corner of the foundation, a block 154 is laid by ranging it in off of the blocks 140, 146 and then leveling it using the blocks 140, 146 as guides. When laying the blocks 148, 150, 152, 154, some mortar may be left out of the corner head joints in order to facilitate mounting the block leveling devices 126, 128 on the blocks 148, 150, 152, 154 during the laying of a third course of blocks.

By utilizing multiple sets of block leveling devices, the second course of two or more of the walls can be formed simultaneously. Thus, for instance, it is possible to form all four second courses simultaneously by employing four sets of block leveling devices.

Figure 16:
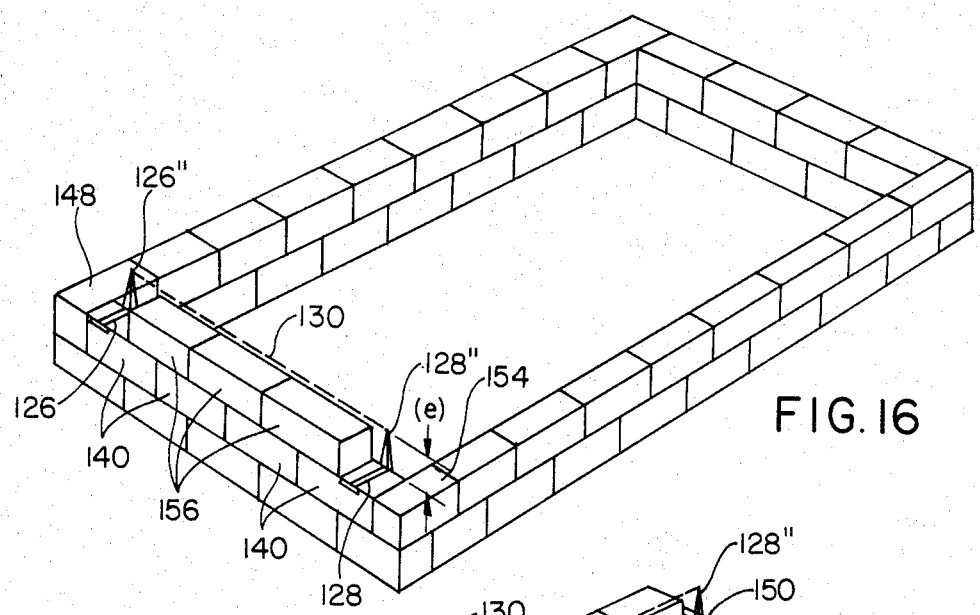

Referring to FIG. 16, with the block leveling device 126 mounted on the northern half of the northernmost one of the blocks 140 and the block leveling device 128 mounted on the southern half of the southernmost one of the blocks 140, the guide line 130 is strung between the upper guiding mechanisms 126", 128" such that the guide line 130 is guided in a generally horizontal direction at a preselected elevation (e) above the blocks 140. Interior blocks 156 of a third course of the west wall are then laid between the block leveling devices 126, 128 using the guide line 130 to facilitate their leveling and plumbing. The preselected elevation (e) is approximately equal to the height of the blocks 156 plus the thickness of the mortar between the second and third courses.

Figure 17:
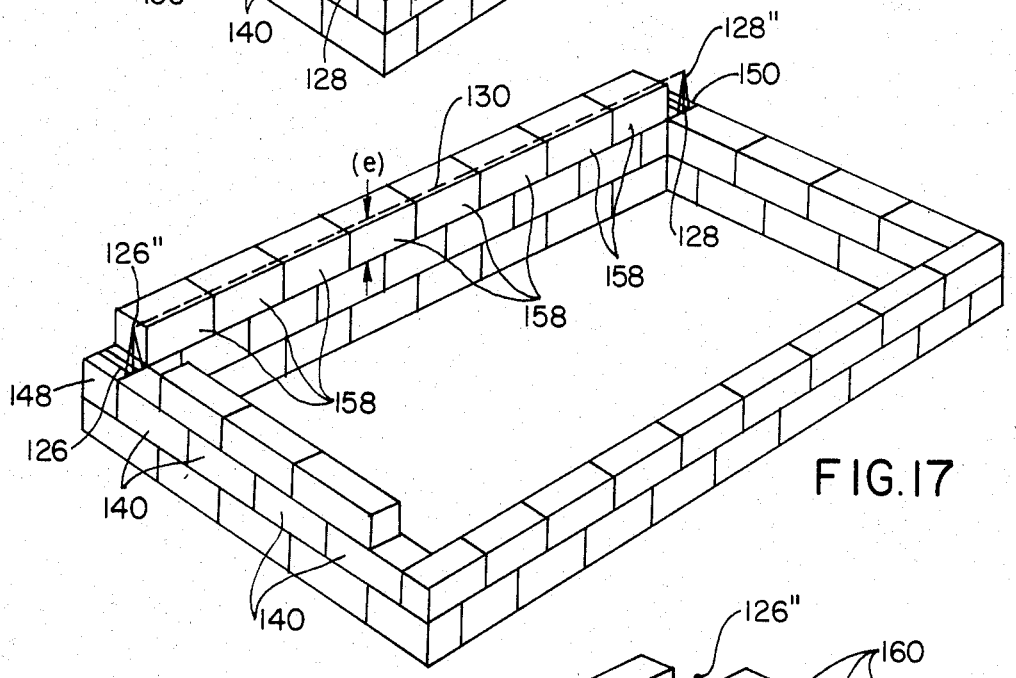

Referring to FIG. 17, with the block leveling device 126 mounted on the western half of the block 148 and the block leveling device 128 mounted on the eastern half of the block 150, the guide line 130 is strung between the upper guiding mechanisms 126", 128" such that the guide line 130 is guided in a generally horizontal direction at a preselected elevation (e) above the blocks 142, 148, 150. Interior blocks 158 of a third course of the north wall are then laid between the block leveling devices 126, 128 using the guide line 130 to facilitate their leveling and plumbing. The preselected elevation (e) is approximately equal to the height of the blocks 158 plus the thickness of the mortar between the second and third courses.

Figure 18:
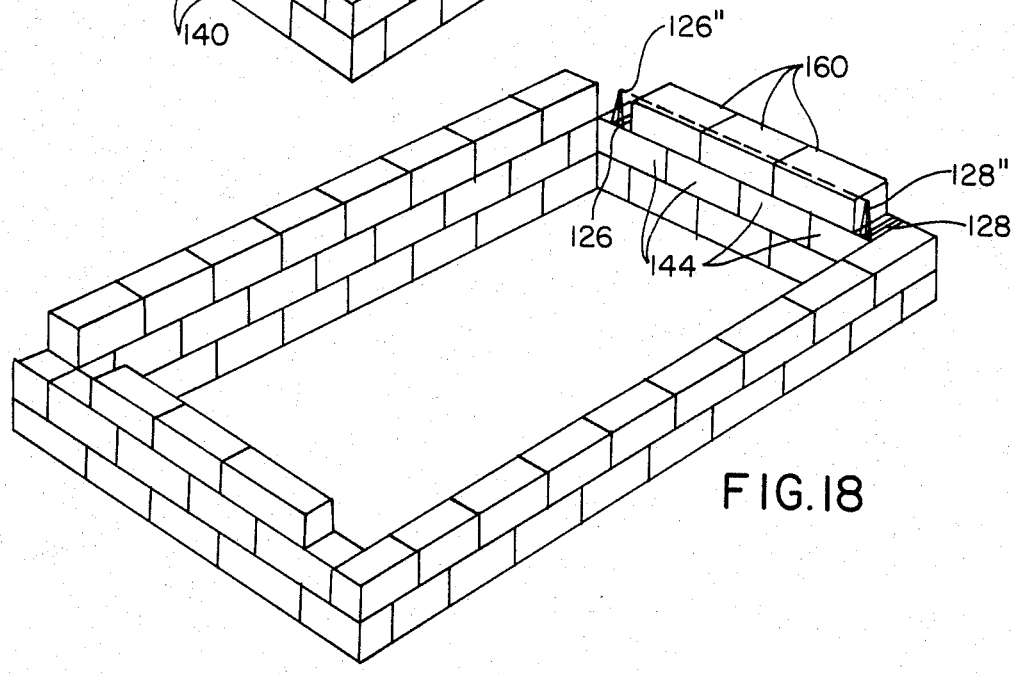

Referring to FIG. 18, with the block leveling device 126 mounted on the northern half of the northernmost one of the blocks 144 and the block leveling device 128 mounted on the southern half of the southernmost one of the blocks 144, the guide line 130 is strung between the upper guiding mechanisms 126", 128" such that the guide line 130 is guided in a generally horizontal direction at a preselected elevation (e) above the blocks 144. Interior blocks 160 of a third course of the east wall are then laid between the block leveling devices 126, 128 using the guide line 130 to facilitate their leveling and plumbing. The preselected elevation (e) is approximately equal to the height of the blocks 160 plus the thickness of the mortar between the second and third courses.

Figure 19:
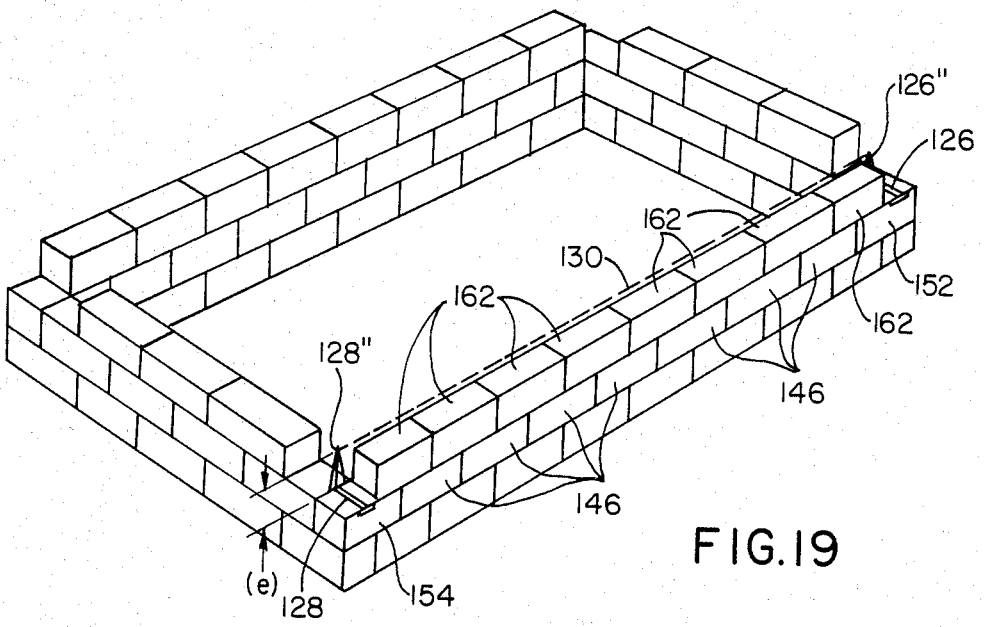

Referring to FIG. 19, with the block leveling device 126 mounted on the eastern half of the block 152 and the block leveling device 128 mounted on the western half of the block 154, the guide line 130 is strung between the upper guiding mechanisms 126", 128" such that the guide line 130 is guided in a generally horizontal direction at a preselected elevation (e) above the blocks 146, 152, 154. Interior blocks 162 of a third course of the south wall are then laid between the block leveling devices 126, 128 using the guide line 130 to facilitate their leveling and plumbing. The preselected elevation (e) is approximately equal to the height of the blocks 162 plus the thickness of the mortar between the second and third courses.

Figure 20:
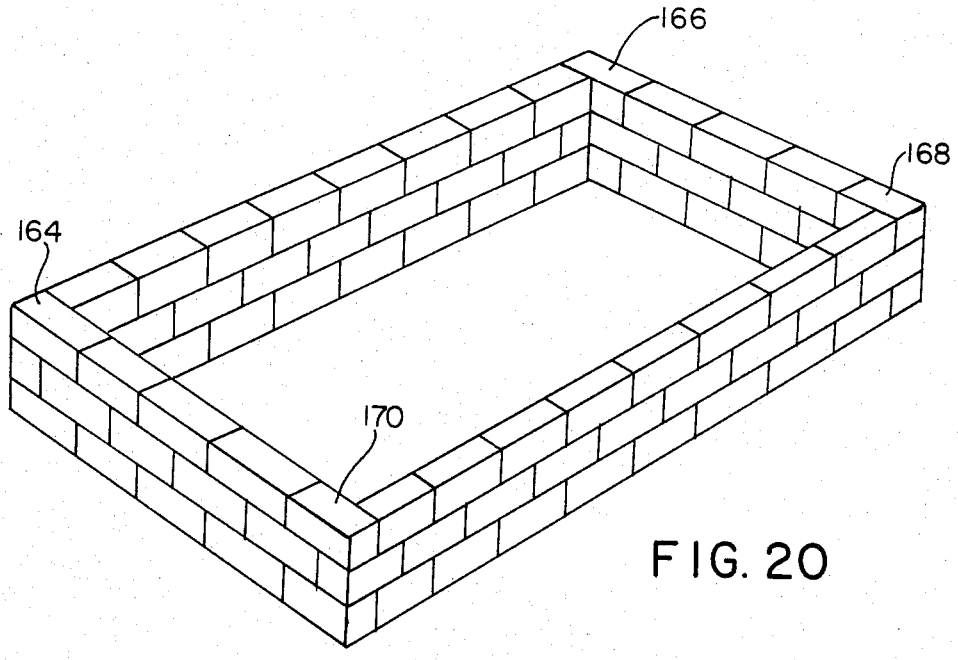

Referring now to FIG. 20, with the block leveling devices 126, 128 removed, any missing mortar is applied to the corner head joints of the blocks 148, 150, 152, 154. Then, a block 164 is laid in the northwest corner of the foundation by ranging it in off of the blocks 156, 158 and then leveling it using the blocks 156, 158 as guides. In the northeast corner of the foundation, a block 166 is laid by ranging it in off of the blocks 158, 160 and then leveling it using the blocks 158, 160 as guides. A block 168 is laid in the southeast corner of the foundation by ranging it in off of the blocks 160, 162 and then leveling it using the blocks 160, 162 as guides. In the southwest corner of the foundation, a block 170 is laid by ranging it in off of the blocks 156, 162 and then leveling it using the blocks 156, 162 as guides. When laying the blocks 164, 166, 168, 170, some mortar may be left out of the corner head joints in order to facilitate mounting the block leveling devices 126, 128 on the blocks 164, 166, 168, 170 during the laying of a fourth course of blocks.

By utilizing multiple sets of block leveling devices, the third course of two or more of the walls can be formed simultaneously. Thus, for instance, it is possible to form all four third courses simultaneously by employing four sets of block leveling devices.

The fourth course and any other additional courses would be formed in essentially the same manner as the third course. Thus, regardless of the number of courses, the entire foundation can be formed without having to construct lead corners.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A method of laying multiple courses of masonry blocks, comprising the steps of laying and leveling a first block at one end of a first course; laying and leveling a second block at an opposite end of said first course; mounting a first leveling device on said first block and said first block only, said first leveling device including first and second guiding means; mounting a second leveling device on said second block and said second block only, said second leveling device including first and second guiding means; attaching a guide line to said first leveling device such that said guide line is guided by said first guiding means thereof; attaching said guide line to said second leveling device such that said guide line is guided by said first guiding means thereof which cooperates with said first guiding means of said first leveling device to guide said guide line in a generally horizontal direction along aligned upper edges of the first and second blocks; laying interior blocks of said first course between said first and second blocks using said guide line to facilitate the leveling of said interior blocks of said first course; attaching the same or another guide line to said first leveling device such that said same or another guide line is guided by said second guiding means thereof; attaching said same or another guide line to said second leveling device such that said same or another guide line is guided by said second guiding means thereof which cooperates with said second guiding means of said first leveling device to guide said same or another guide line in a generally horizontal direction at a preselected elevation above the upper edges of the first and second blocks; laying interior blocks of a second course above said first course using said same or another guide line to facilitate the leveling of said interior blocks of said second course, whereby at least two substantially complete course can be laid and leveled without having to move said first and second leveling devices and without having to construct lead corners.

2. A method according to claim 1, wherein said first and second blocks and said interior blocks therebetween form a portion of a first wall of a foundation.

3. A method according to claim 2, further comprising the steps of laying and leveling a third block adjacent to an end of said first block, said third block being arranged at a right angle relative to said first block, whereby said first and third blocks form a corner of the foundation; laying and leveling a fourth block in an adjacent corner of the foundation, said fourth block being arranged parallel to said third block; mounting said first or another similar leveling device on said third block and said third block only; mounting said second or another similar leveling device on said fourth block and said fourth block only; attaching said same or another guide line to said first or another similar leveling device such that said same or another guide line is guided by said first guiding means thereof; attaching said same or another guide line to said second or another similar leveling device such that said same or another guide line is guided by said first guiding means thereof which cooperates with said first guiding means of said first or another similar leveling device to guide said guide line in a generally horizontal direction along aligned upper edges of said third and fourth blocks; laying interior blocks of a first course of a second wall of the foundation between said third and fourth blocks using said same or another guide line to facilitate the leveling of said interior blocks of said first course of said second wall of the foundation; attaching said same or another guide line to said first or another similar leveling device such that said same or another guide line is guided by said second guiding means thereof; attaching said same or another guide line to said second or another similar leveling device such that said same or another guide line is guided by said second guiding means thereof which cooperates with the second guiding means of said first or another similar leveling device to guide said same or another guide line in a generally horizontal direction at a preselected elevation above the upper edges of said third and fourth blocks; and laying interior blocks of a second course of the second wall above said first course of the second all using said same or another guide line to facilitate the leveling of said interior blocks of said second course of said second wall.

4. A method of making a foundation from masonry blocks, the foundation including a plurality of walls, said method comprising the steps of:

(a) laying and leveling two blocks in each corner of the foundation;

(b) forming a first course of blocks for one wall of the foundation by mounting a first leveling device, which includes first and second guiding means, on a first block and said first block only, said first block being located in a corresponding one of the corners of the foundation, mounting a second leveling device, which includes first and second guiding means, on a second block and said second block only, said second block being located in an adjacent corner of the foundation and being arranged parallel to said first block, attaching a guide line to said first leveling device such that said guide line is guided by said first guiding means thereof, attaching said guide line to said second leveling device such that said guide line is guided by said first guiding means thereof which cooperates with said first guiding means of said first leveling device to guide said guide line in a generally horizontal direction along aligned upper edges of said first and second blocks, and laying additional blocks between said first and second blocks using said guide line to facilitate the leveling of said additional blocks;

(c) carrying out step (b) for each wall of the foundation;

(d) forming a second course for said one wall of the foundation by attaching the same or another guide line to said first leveling device, which is mounted on said first block and said first block only, such that said guide line is guided by said second guiding means thereof, attaching said same or another guide line to said second leveling device, which is mounted on said second block and said second block only, such that said same or another guide line is guided by said second guiding means thereof which cooperates with said second guiding means of said first leveling device to guide said same or another guide line in a generally horizontal direction at a preselected elevation above said upper edges of said first and second blocks, laying interior blocks of said second course above said first course using said same or another guide line to facilitate the leveling of said interior blocks of said second course;

(e) carrying out step (d) for each wall of the foundation, whereby each corner of the foundation is missing a second course block; and (f) completing the second course of the foundation by laying blocks in each corner of the foundation using said interior blocks of said second course as guides, whereby the foundation can be constructed without having to construct lead corners.

5. A method of making a foundation according to claim 4, further comprising the steps of:

(g) forming a third course for said one wall of the foundation by mounting said first leveling device on a third block and said third block only, said third block being located in said corresponding one of the corners of the foundation, mounting said second leveling device on a fourth block and said fourth block only, said fourth block being located in said adjacent corner of the foundation and being arranged parallel to said third block, attaching said same or another guide line to said first leveling device such that said guide line is guided by said second guiding means thereof, attaching said same or another guide line to said second leveling device such that said guide line is guided by said second guiding means thereof which cooperates with said second guiding means of said first leveling device to guide said guide line in a generally horizontal direction at a preselected elevation above said second course of blocks, and laying interior blocks of said third course above said second course using said same or another guide line to facilitate the leveling of said interior blocks of said third course;

(h) carrying out step (g) for each wall of the foundation, whereby each corner of the foundation is missing a third course block; and (i) completing the third course of the foundation by laying a block in each corner of the foundation using said interior blocks of said third course as guides.

6. A method of making a foundation according to claim 4, wherein multiple sets of leveling devices are used such that at least two walls of the foundation are constructed simultaneously.

7. A method of making a foundation according to claim 4, wherein one set of leveling devices is used such that the walls of the foundation are constructed sequentially.

* * * * *